US006769423B1

(12) United States Patent
Zhang

(10) Patent No.: US 6,769,423 B1
(45) Date of Patent: Aug. 3, 2004

(54) SANDWICH TUCK POINTING BLADE

(76) Inventor: Charlie Zhang, 1361 Ashley La., Addison, IL (US) 60101

( * ) Notice: Subject to any disclaimer, the term of this patent is extended or adjusted under 35 U.S.C. 154(b) by 0 days.

(21) Appl. No.: 10/251,743

(22) Filed: Sep. 20, 2002

Related U.S. Application Data

(60) Provisional application No. 60/391,579, filed on Jun. 27, 2002.

(51) Int. Cl.[7] ..... B28D 1/04

(52) U.S. Cl. ..... 125/13.01; 125/15

(58) Field of Search ..... 125/13.01, 15; 83/664; 451/540; 30/501, 503, 503.5

(56) References Cited

U.S. PATENT DOCUMENTS

| | | | | | |
|---|---|---|---|---|---|
| 2,475,892 | A | * | 7/1949 | Hasty | 125/15 |
| 2,709,878 | A | * | 6/1955 | Barnes | 451/352 |
| 2,807,256 | A | * | 9/1957 | Olson | 125/13.01 |
| 3,127,887 | A | * | 4/1964 | Metzger | 125/15 |
| 3,261,383 | A | * | 7/1966 | Woolley | 83/63 |
| 3,866,502 | A | * | 2/1975 | Brewer, Sr. | 83/477.2 |
| 4,033,319 | A | * | 7/1977 | Winter | 125/13.01 |
| 4,188,934 | A | * | 2/1980 | Reinhardt et al. | 125/4 |
| 4,236,356 | A | * | 12/1980 | Ward | 451/352 |
| 4,516,560 | A | | 5/1985 | Cruickshank et al. | |
| 4,550,708 | A | | 11/1985 | Roemmele et al. | |
| 4,583,515 | A | | 4/1986 | Ballenger | |
| 4,962,748 | A | | 10/1990 | Schweickhardt | |
| 5,020,280 | A | * | 6/1991 | O'Reilly | 451/342 |
| 5,115,796 | A | | 5/1992 | Schweickhardt | |
| 5,197,453 | A | * | 3/1993 | Messina | 125/15 |
| 5,261,385 | A | * | 11/1993 | Kroll | 125/13.01 |
| 5,313,742 | A | * | 5/1994 | Corcoran et al. | 451/541 |
| 5,392,758 | A | * | 2/1995 | Rognon | 125/13.01 |
| 5,441,033 | A | * | 8/1995 | Chiuminatta et al. | 125/15 |
| 5,505,189 | A | * | 4/1996 | Chiuminatta et al. | 125/12 |
| 5,507,273 | A | * | 4/1996 | Chiuminatta et al. | 125/13.01 |
| 5,537,987 | A | * | 7/1996 | Okawauchi | 125/15 |
| 5,787,871 | A | | 8/1998 | Jones et al. | |
| 6,142,139 | A | * | 11/2000 | Lupi | 125/15 |
| 6,321,738 | B1 | | 11/2001 | Walsh | |
| 6,371,103 | B1 | * | 4/2002 | Lupi | 125/40 |

FOREIGN PATENT DOCUMENTS

| | | | |
|---|---|---|---|
| DE | 4239570 | A1 * | 5/1994 |

* cited by examiner

*Primary Examiner*—M. Rachuba
(74) *Attorney, Agent, or Firm*—Pauley Petersen & Erickson

(57) ABSTRACT

A tuck pointing blade includes at least two saw blades, each having multiple slots positioned radially around a perimeter, and a gap between a perimeter cutting surface of each adjacent saw blade. Each saw blade is arranged so that the multiple slots are offset relative to the multiple slots in each adjacent saw blade. In addition, the tuck pointing blade can be configured with three or more saw blades including adjacent blades having different physical properties and/or materials.

19 Claims, 2 Drawing Sheets

SANDWICH TUCK POINTING BLADE

This application claims the benefit of Provisional Application no. 60/391,579, filed Jun. 27, 2002.

BACKGROUND OF THE INVENTION

1. Field of the Invention

This invention relates to a tuck pointing saw blade having two or more adjacent saw blades.

2. Description of Related Art

Tuck pointing blades are used to trim and/or remove mortar in brickwork and other masonry. Typically, a tuck pointing blade is a single saw blade having a particular kerf pattern used to remove old mortar. This operation is generally time-consuming and places a great deal of stress and wear on both the tuck pointing blade and the associated power tool.

SUMMARY OF THE INVENTION

It is one object of this invention to provide a tuck pointing blade that cuts mortar rather than grinds mortar like conventional blades.

It is another object of this invention to provide a tuck pointing blade having multiple saw blades, each saw blade having slots rotationally offset relative to each adjacent saw blade.

It is yet another object of this invention to provide a tuck pointing blade having multiple saw blades including at least one saw blade formed of a different material than at least one other saw blade.

A tuck pointing blade according to a preferred embodiment of this invention includes at least two saw blades each having multiple slots positioned radially around a perimeter. Preferred embodiments of this invention include two or three saw blades however additional embodiments may include four, five, six, seven or more saw blades.

The saw blades are preferably diamond saw blades chosen for durability and strength in tuck pointing applications, particularly saw blades known to those having ordinary skill in the art to be suitable for cutting masonry, concrete, brick, mortar and other such materials.

A spacer may be positioned between each adjacent saw blade to create a gap between a perimeter cutting surface of each adjacent saw blade. Each adjacent saw blade is preferably welded around a center ring that forms an arbor hole of the tuck pointing blade. The spacer, such as a washer, is preferably positioned between each saw blade and is attached around the center ring.

According to a preferred embodiment of this invention, the slots of each saw blade are rotationally offset relative to the slots in each adjacent saw blade. More specifically, the slots of each saw blade are preferably approximately centered between the slots of each adjacent saw blade.

According to one preferred embodiment of this invention, at least one saw blade of the tuck pointing blade may be formed of a softer material than at least one other saw blade to promote equal wear across perimeters of each saw blade in the tuck pointing blade.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

FIGS. 1–4 show tuck pointing blades 10 according to several preferred embodiments of this invention. Tuck pointing blade 10 preferably comprises two or more saw blades 20 sandwiched together. Tuck pointing blade 10 may then be used to trim and/or remove mortar and other material from within and between bricks and similar masonry work.

Figure 1:
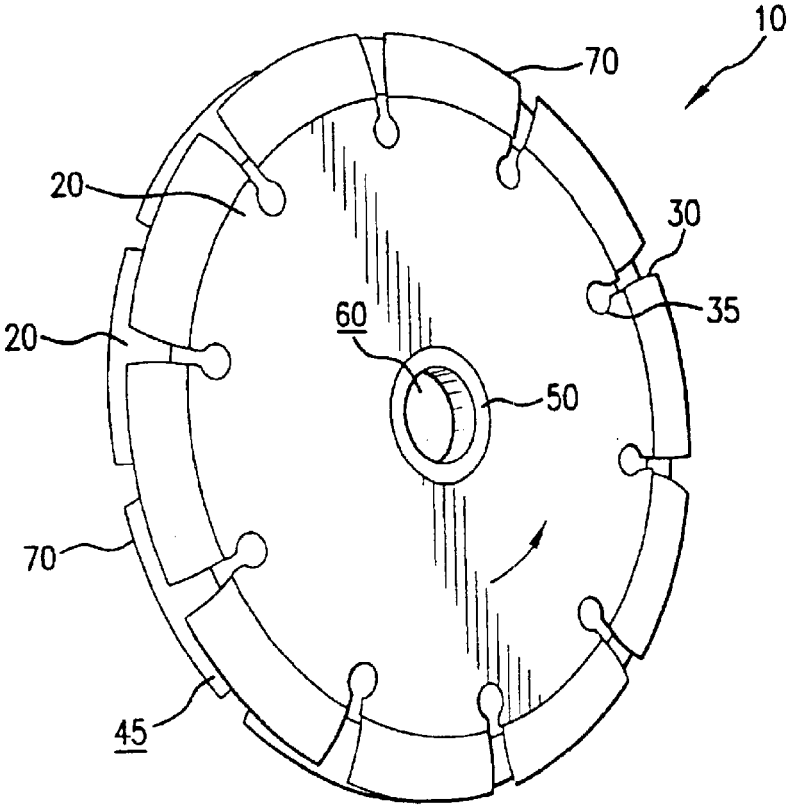
FIG. 1 is a front perspective view of a tuck pointing blade according to one preferred embodiment of this invention.

Tuck pointing blade 10 according to a preferred embodiment of this invention comprises two or more saw blades 20, preferably diamond saw blades, that include multiple slots 30 positioned radially around each saw blade 20. As shown in FIG. 1, slots 30 may generally taper inwardly toward a center of saw blade 20 and terminate in a central radius 35.

The saw blades 20 are spaced relative to each adjacent saw blade 20 to create gaps 45 between a perimeter cutting surface 70 of each adjacent saw blade 20. As a result, each adjacent saw blade 20 is spaced relative to each other at least along a perimeter cutting surface 70, and preferably such gap 45 extends through tuck pointing blade 10 and terminates approximately at center ring 50 and/or spacer 40.

Slots 30 of each saw blade 20 are preferably rotationally offset relative to slots 30 in each adjacent saw blade 20. Rotationally offset cutting segments between each saw blade 20 enables aggressive cutting performance. The multiple saw blade structure of tuck pointing blade 10 results in a rapid cutting action of mortar instead of a grinding action thereby resulting in 30–40% more mortar removed per hour of cutting than a conventional tuck pointing blade. In addition, the spaced saw blades 20 result in a substantially lighter tuck pointing blade 10 than a conventional tuck pointing blade resulting in less operator fatigue than conventional blades and cooler running cutting equipment. The reduced weight of the subject tuck pointing blade 10 results in cooler temperatures and increased motor life for cutting equipment as less amps are drawn by the lighter blade.

The profile of tuck pointing blade 10 is generally rectangular in cross-section, even after tuck pointing blade 10 is substantially worn. As a result, the tuck pointing blade leaves a generally square bottom in the mortar which meets standard architectural requirements.

Each adjacent saw blade 20 is preferably welded or otherwise attached around center ring 50 that forms the arbor hole 60 of tuck pointing blade 10. In addition, spacer 40, such as a washer, is may be positioned between each saw blade 10 and may be welded or otherwise attached around center ring 50.

Tuck pointing blade 10 is preferably made of a carbon steel core having multiple cutting segments with acceptable percentages of diamond content. Tuck pointing blade 10 may alternatively be formed of any other material or materials known to those having ordinary skill in the art.

Figure 2:
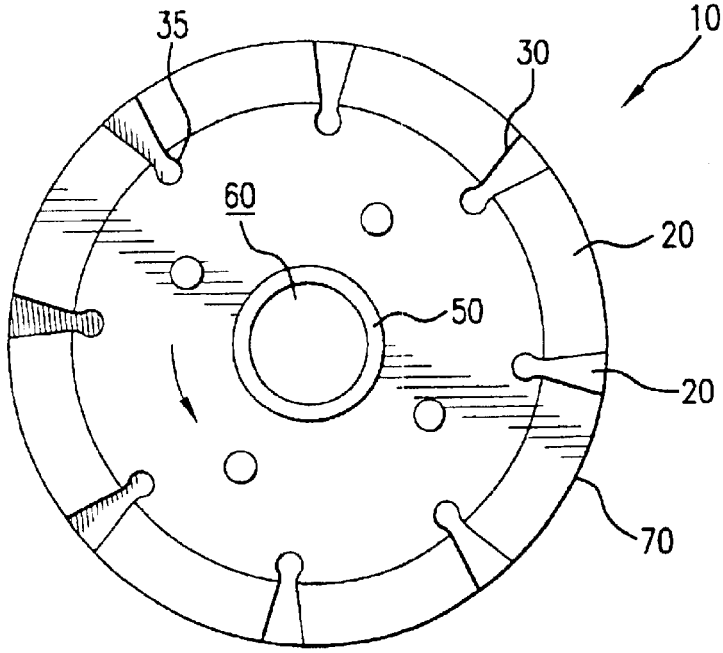
FIG. 2 is a front view of a tuck pointing blade according to one preferred embodiment of this invention.

According to one preferred embodiment of this invention shown in FIGS. 1 and 2, two saw blades 20 are joined together and spaced and separated using spacer 40, preferably a washer, attached around a center arbor hole 60. Each saw blade 20 preferably includes a plurality of radially positioned slots 30 that extend partially through saw blade 20 toward a center of the saw blade 20. The adjacent saw blades 20 are rotationally offset relative to each other so that the radial slots 30 of the first saw blade 22 are approximately centered between the radial slots 30 of the second saw blade 24.

Figure 3:
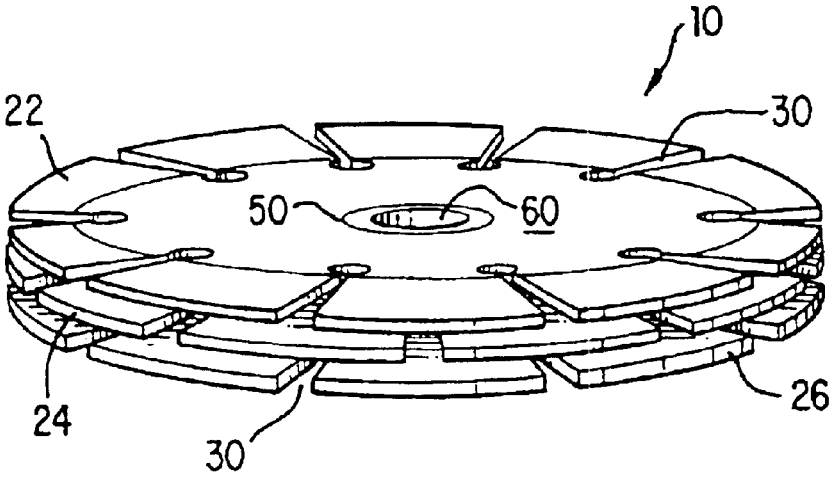
FIG. 3 is a side perspective view of a tuck pointing blade according to one preferred embodiment of this invention.
Figure 4:
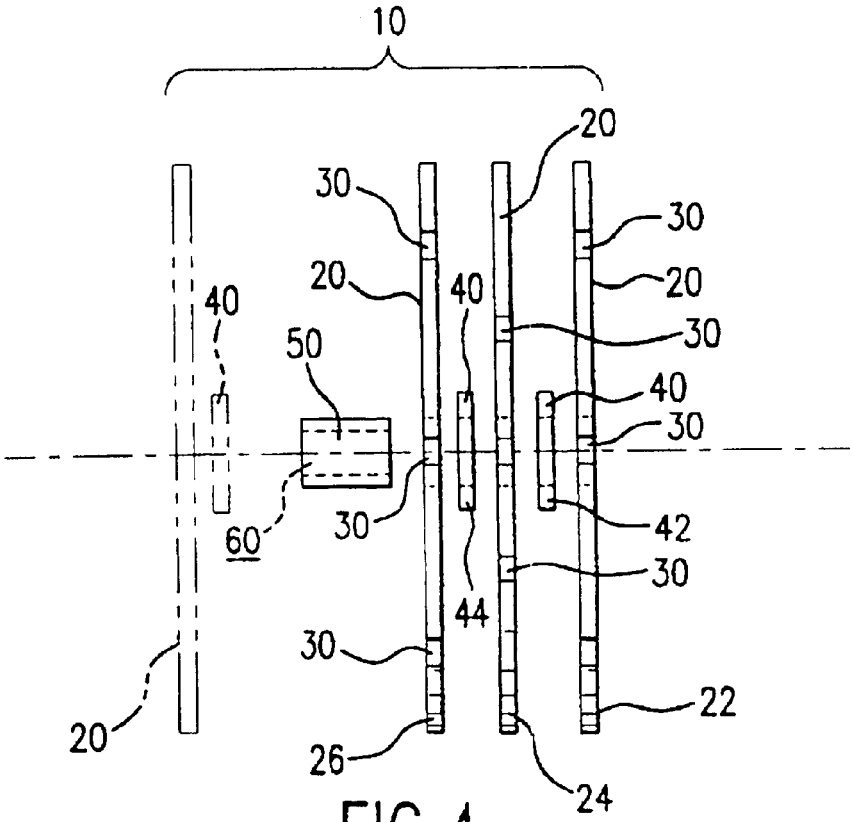
FIG. 4 is an exploded schematic view of a tuck pointing blade according to one preferred embodiment of this invention.

According to another preferred embodiment of this invention, shown in FIGS. 3 and 4, three saw blades 20 are joined together and each spaced and separated using spacer 40 attached around a center arbor hole 60. As a result, tuck pointing blade 10 according to this embodiment includes, in order: first saw blade 22, first spacer 42, second saw blade 24, second spacer 44 and third saw blade 26. Each saw blade 20 preferably includes a plurality of radially positioned slots 30 that extend partially through saw blade 20 toward a center. Each adjacent saw blade 20 is rotationally offset relative to the next so that slots 30 of first saw blade 22 are approximately centered between slots 30 of second saw blade 24 and slots 30 of third saw blade 26 are likewise centered between slots 30 of second saw blade 24. As such, radially extending slots 30 of first saw blade 22 are generally aligned with radially extending slots of third saw blade 26.

Finally, and as shown schematically in FIG. 4, tuck pointing blade 10 may include more than three saw blades 20 arranged in a similar manner as described above wherein each saw blade 20 is spaced and offset relative to each adjacent saw blade 20. Therefore, tuck pointing blade 10 may include four, five, six or seven or more saw blades 20 spaced and offset relative to each other.

According to one preferred embodiment of this invention, the center saw blade or blades, such as second saw blade 24 shown in FIGS. 3 and 4, in a multiple saw blade arrangement may be formed of a softer material to promote equal wear across the perimeters of each saw blade 20 in tuck pointing blade 10. Without such softer center saw blade, the outer saw blades may wear faster thereby resulting in uneven cutting of brick mortar. Accordingly, one or more saw blades 20 within tuck pointing blade 10 may include different physical properties and/or materials than one or more adjacent saw blades 20.

While in the foregoing specification this invention has been described in relation to certain preferred embodiments thereof, and many details have been set forth for purpose of illustration, it will be apparent to those skilled in the art that the saw blade according to this invention is susceptible to additional embodiments and that certain of the details described herein can be varied considerably without departing from the basic principles of the invention.

I claim:

1. A tuck pointing blade comprising:

at least two saw blades each having multiple slots positioned radially around a perimeter, the at least two saw blades arranged around a central arbor to create a gap between a perimeter cutting surface of each adjacent saw blade, wherein at least one saw blade of the at least two saw blades is formed of a softer material than at least one other saw blade to promote equal wear across perimeters of each saw blade in the tuck pointing blade.

2. The tuck pointing blade of claim 1 wherein the slots of each saw blade are rotationally offset relative to the slots in each adjacent saw blade.

3. The tuck pointing blade of claim 1 wherein the at least two saw blades are diamond saw blades.

4. The tuck pointing blade of claim 1 wherein the least two saw blades include a generally rectangular cross-section.

5. The tuck pointing blade of claim 1 where each adjacent saw blade is welded around a center ring that forms an arbor hole of the tuck pointing blade.

6. The tuck pointing blade of claim 5 wherein a spacer is positioned between each saw blade and is attached around the center ring.

7. The tuck pointing blade of claim 1 wherein the tuck pointing blade comprises a carbon steel core and multiple cutting segments with diamond content.

8. The tuck pointing blade of claim 1 wherein the plurality of slots extend partially through each saw blade toward a center of the saw blade.

9. The tuck pointing blade of claim 1 wherein adjacent saw blades are rotationally offset relative to each other so that the slots of a first saw blade are approximately centered between the slots of a second saw blade.

10. The tuck pointing blade of claim 1 wherein three saw blades are joined together and are each spaced and separated using a spacer attached around a center arbor hole.

11. The tuck pointing blade of claim 10 wherein each adjacent saw blade is rotationally offset relative to each other so that the slots of a first saw blade are approximately centered between the slots of a second saw blade and the slots of a third saw blade are approximately centered between the slots of the second saw blade, thereby generally aligning the slots of the first saw blade with the slots of the third saw blade.

12. The tuck pointing blade of claim 1 wherein four saw blades are joined together and are each spaced and separated using a spacer attached around a center arbor hole.

13. The tuck pointing blade of claim 1 wherein five saw blades are joined together and are each spaced and separated using a spacer attached around a center arbor hole.

14. The tuck pointing blade of claim 1 wherein six saw blades are joined together and are each spaced and separated using a spacer attached around a center arbor hole.

15. A tuck pointing blade comprising:

at least two saw blades each having multiple slots positioned radially around a perimeter;

a spacer positioned between the at least two saw blades to create a gap between a perimeter cutting surface of each adjacent saw blade, the at least two saw blades positioned so that the multiple slots of each saw blade are rotationally offset relative to the multiple slots in each adjacent saw blade, wherein at least one saw blade of the at least two saw blades is formed of a softer material than at least one other saw blade to promote equal wear across perimeters of each saw blade in the tuck pointing blade.

16. The tuck pointing blade of claim 15 comprising a generally rectangular cross-section.

17. The tuck pointing blade of claim 15 wherein three saw blades are joined together and are each spaced and separated using a spacer attached around a center arbor hole.

18. The tuck pointing blade of claim 15 wherein each adjacent saw blade is rotationally offset relative to each other so that the slots of a first saw blade are approximately centered between the slots of a second saw blade and the slots of a third saw blade are approximately centered between the radial slots of the second saw blade, thereby generally aligning the slots of the first saw blade with the slots of the third saw blade.

19. A tuck pointing blade comprising:

a first saw blade having multiple slots positioned radially around a perimeter;

a second saw blade having multiple slots positioned radially around a perimeter;

a third saw blade having multiple slots positioned radially around a perimeter, wherein at least one saw blade of the first saw blade, the second saw blade and the third saw blade is formed of a softer material than at least one other saw blade;

a first spacer positioned between the first saw blade and the second saw blade to create a gap between a perimeter cutting surface of the first saw blade and a perimeter cutting surface of the second saw blade; and a second spacer positioned between the second saw blade and the third saw blade to create a gap between a perimeter cutting surface of the second saw blade and a perimeter cutting surface of the third saw blade.

* * * * *